US005813577A

United States Patent [19]

Lee

[11] Patent Number: 5,813,577

[45] Date of Patent: Sep. 29, 1998

[54] COLLAPSIBLE DISPENSER

[76] Inventor: Wan Ki Lee, 11722 Westshore Ct., Cupertino, Calif. 95014

[21] Appl. No.: 715,586

[22] Filed: Sep. 18, 1996

[51] Int. Cl.[6] ..... B65D 37/00

[52] U.S. Cl. ..... 222/212; 222/209; 222/215; 222/529; 222/536

[58] Field of Search ..... 222/206, 209, 222/212, 215, 529, 532, 533, 536, 537, 92, 95, 96; 220/670, 672

[56] References Cited

U.S. PATENT DOCUMENTS

| | | | |
|---|---|---|---|
| 687,790 | 12/1901 | Scales . | |
| 1,934,699 | 11/1933 | Christen . | |
| 2,009,761 | 7/1935 | Calderara . | |
| 2,250,022 | 7/1941 | Hoffman . | |
| 2,268,993 | 1/1942 | Sanders . | |
| 2,649,995 | 8/1953 | Muskin . | |
| 2,772,027 | 11/1956 | Chircop . | |
| 2,780,378 | 2/1957 | Romano . | |
| 3,083,877 | 4/1963 | Gash . | |
| 3,118,572 | 1/1964 | Harding . | |
| 3,285,473 | 11/1966 | Fuhrmann | 222/537 |
| 3,289,891 | 12/1966 | Frankenberg . | |
| 3,390,821 | 7/1968 | Mullan . | |
| 3,433,391 | 3/1969 | Krizka et al. . | |
| 3,506,163 | 4/1970 | Rauh et al. . | |
| 3,587,937 | 6/1971 | Childs . | |
| 3,873,003 | 3/1975 | Seiferth et al. . | |
| 3,946,903 | 3/1976 | Parker . | |
| 4,592,492 | 6/1986 | Tidmore . | |
| 4,622,085 | 11/1986 | Yamada et al. | 156/94 |
| 5,088,632 | 2/1992 | Odet et al. | 222/529 |
| 5,115,948 | 5/1992 | Johnson . | |
| 5,207,250 | 5/1993 | Tsao . | |
| 5,333,761 | 8/1994 | Davis et al. . | |
| 5,356,037 | 10/1994 | Harrold | 222/95 |

FOREIGN PATENT DOCUMENTS

| | | |
|---|---|---|
| 725864 | 5/1932 | France . |
| 2681767 | 4/1993 | France . |
| 2227580 | 1/1974 | Germany . |
| 1114691 | 5/1968 | United Kingdom . |

*Primary Examiner*—Kevin P. Shaver
*Assistant Examiner*—David Deal
*Attorney, Agent, or Firm*—Jacobson, Price, Holman & Stern, PLLC

[57] ABSTRACT

A collapsible dispenser includes a main storage tank for storing material contents, a hook structure for catching a used-up portion of a collapsible side wall of the main storage tank to be kept folded, a top cap attached to the main storage tank for outputting the material contents from the main storage tank, and a bottom plug. The main storage tank includes a tank base and a collapsible side wall. The hook structure extends from the inside shoulder of the top cap and includes a keeper wall extended from the inside shoulder, a thickened lower edge formed at a lower edge of the keeper wall, and a hook formed at the end of the edge. A bottom plug is attached to the tank base of the main storage tank for refilling the material contents inside the main storage tank. The collapsible side wall includes a plurality of bellows folds. Each of the folds has a circumferential protruded lip which conforms to and cooperates with the hook for preventing sliding of a folded portion of the collapsible side wall. The keeper wall includes openings for allowing any residual contents left in a folded portion of the collapsible side wall to be squeezed into the main storage tank.

26 Claims, 6 Drawing Sheets

COLLAPSIBLE DISPENSER

BACKGROUND OF THE INVENTION

1. Field of the Invention

The present invention relates to a dispenser. More particularly, the present invention relates to a collapsible dispenser that has a detachable storage tank that may be interchangeable, disposable or reusable, is equipped with multiple shapes of nozzles and uses squeezing rather than pumping action to output the contents.

2. Description of Related Art

The Mullan patent, U.S. Pat. No. 3,390,821, discloses a collapsible container or bottle in combination with a dispensing cap. The bottle has a top wall, with a screw threaded neck, integrally joined at its peripheral edge to a corrugated or accordian pleated tube side wall. The cap can comprise a valve and spout.

The Childs patent, U.S. Pat. No. 3,587,937, relates to a combined collapsible corrugated container and dispensing cap having a projectable and retractable spout.

The Tsao patent, U.S. Pat. No. 5,207,250, relates to a pollutant-proof contractible container with a nonreturn valve in the container neck.

British patent 1,114,691 (to Cockburn) relates to collapsible containers of plastics materials having annular corrugations between the base and top. The container has a screw-on cap containing a valve and spout.

The Rauh et al. patent, U.S. Pat. No. 3,506,163, relates to a collapsible container having annular bellows, spout means, and a bottom end protuberance 22 having a configuration which closely matches that of the inner surface of the neck 16 which serves to displace container material out of the neck itself into the spout means.

The Davis et al. patent, U.S. Pat. No. 5,333,761, relates to a collapsible bottle, comments on the Rauh et al. patent device, and discloses, inter alia, a collapsible bottle base which includes an inwardly directed protrusion thereon having dimensions corresponding to a nozzle interior space and positioned to be inserted into the nozzle from the interior of the container when the container is fully collapsed. In this connection, see also similar features disclosed in the Parker patent, U.S. Pat. No. 3,946,903, the Seiferth et al. patent, U.S. Pat. No. 3,873,073, the Frankenberg patent, U.S. Pat. No. 3,289,891, the Calderara patent, U.S. Pat. No. 2,009,761, and the Scales patent, U.S. Pat. No. 687,790.

German patent 2,227,580 (to Rehner) relates to a collapsible tube having a bellows-type body, wherein the inwardly projecting part of the base may comprise a screwed-in insert (see FIG. 4, component 6).

The Chircop patent, U.S. Pat. No. 2,772,027, is of interest in that it relates to a dispensing cap for a conventional collapsible tube (see col. 2, lines 52–53) wherein the cap consists of a base, a neck and a circular cylindrical closure, with spout, wherein the closure is capable of limited rotary movement.

SUMMARY OF THE INVENTION

The present invention is directed to a collapsible dispenser that substantially obviates one or more of the problems due to limitations and disadvantages of the related art.

A primary object of the present invention is to provide a dispenser with a detachable and refillable storage tank that is disposable, reusable, or interchangeable depending on the intent of the user.

Another object of the present invention is to provide such a tank which dispenses its material contents upon squeezing rather than by the usual pumping action so as to provide a uniform and controllable flow and avoid the intermittent output usually associated with a pumping cycle and which eliminates the moving parts and seals usually required for pumps.

Another object of the present invention is to provide a dispenser that comes with different shapes of nozzles to suit any kind of material content, whether it is in the form of paste, heavy fluid or liquid.

Further objects of the invention will be clear as the description proceeds.

To achieve these objects and provide other advantages, and in accordance of the purpose of the invention as embodied and broadly described, the invention provides a collapsible dispenser including a main storage tank for storing material contents including a collapsible side wall and a tank base. A top cap including an inside shoulder is attached to the main storage tank for outputting the material contents from the main storage tank. A hook structure is provided for catching a used-up portion of the collapsible side wall which is to be kept folded. The hook structure extends from the inside shoulder. A bottom plug is attached to the tank base of the main storage tank for refilling the material contents inside the main storage tank.

BRIEF DESCRIPTION OF THE DRAWINGS

To accomplish the above and related objects, this invention may be embodied in the form illustrated in the associated drawings. Attention is called to the fact that the drawings are illustrative only. Changes may be made in the specific construction illustrated and described within the scope of the appended claims.

DETAILED DESCRIPTION OF THE PREFERRED EMBODIMENT

Reference will now be made in detail to the preferred embodiment of the invention, an example of which is illustrated in the accompanying drawings.

Figure 1:
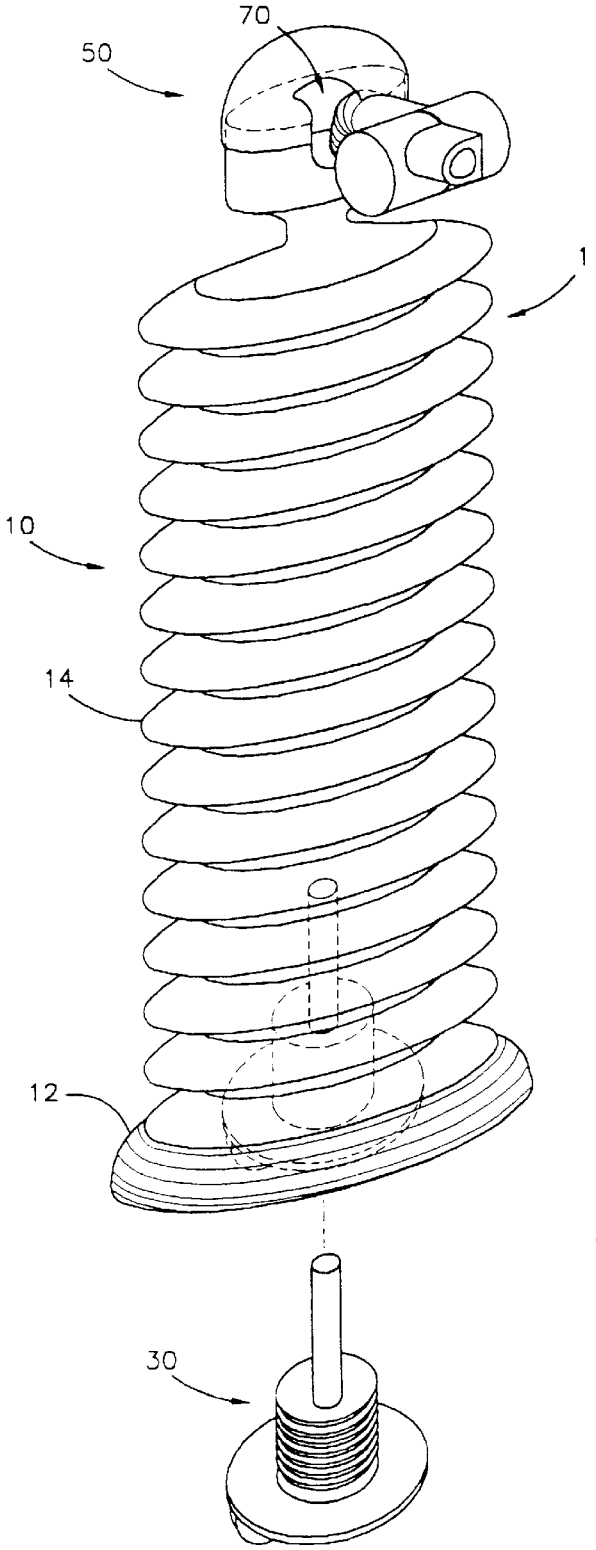
FIG. 1 is a perspective view of the dispenser according to a preferred embodiment of the present invention.

FIG. 1 illustrates a preferred embodiment of the present invention. As shown in FIG. 1, a dispenser according to the present invention is designated generally by reference numeral 1 and includes a main storage tank 10, a top cap 50 and a bottom plug 30 that is represented by dotted lines and receivable within the storage tank 10. The bottom plug 30 is also shown separately below the main storage tank 10. The main storage tank 10 has a collapsible side wall 14 and a tank base 12.

Figure 2:
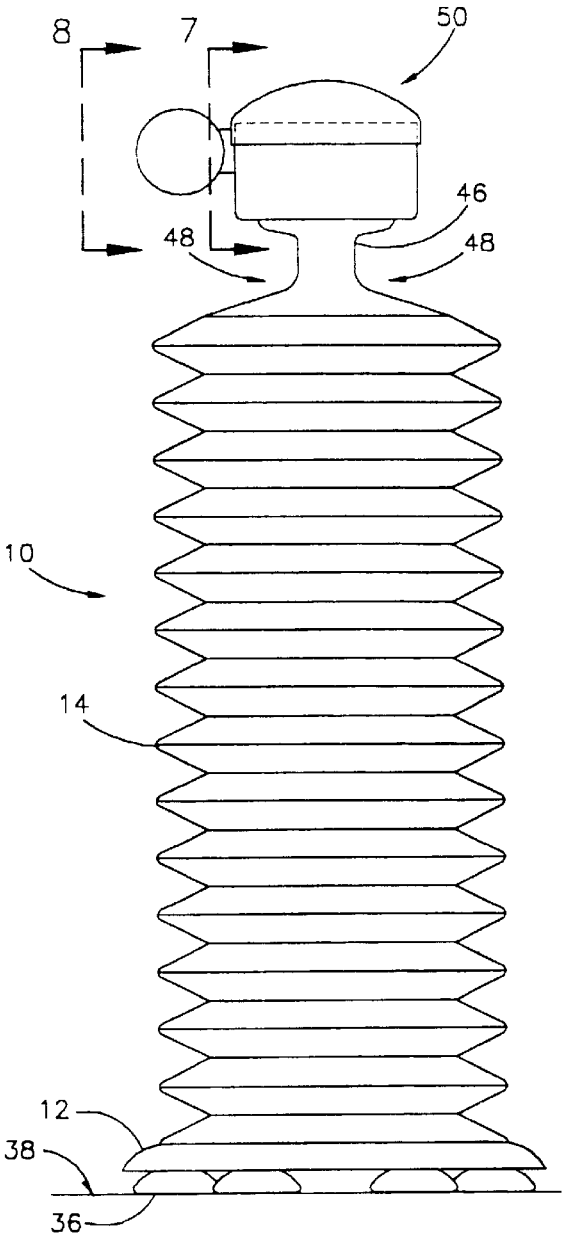
FIG. 2 is a side view of the dispenser according to a preferred embodiment of the present invention.

FIG. 2 is a side view of the invention. Suction cups 36 are formed or attached under the main storage tank 10. The dispenser 1 can sit on a flat surface 38 with the suction cups 36 not pressed down. Alternatively, the suction cups 36 may be pressed down for semi-fixed seating, as better seen in FIG. 10.

Figure 3:
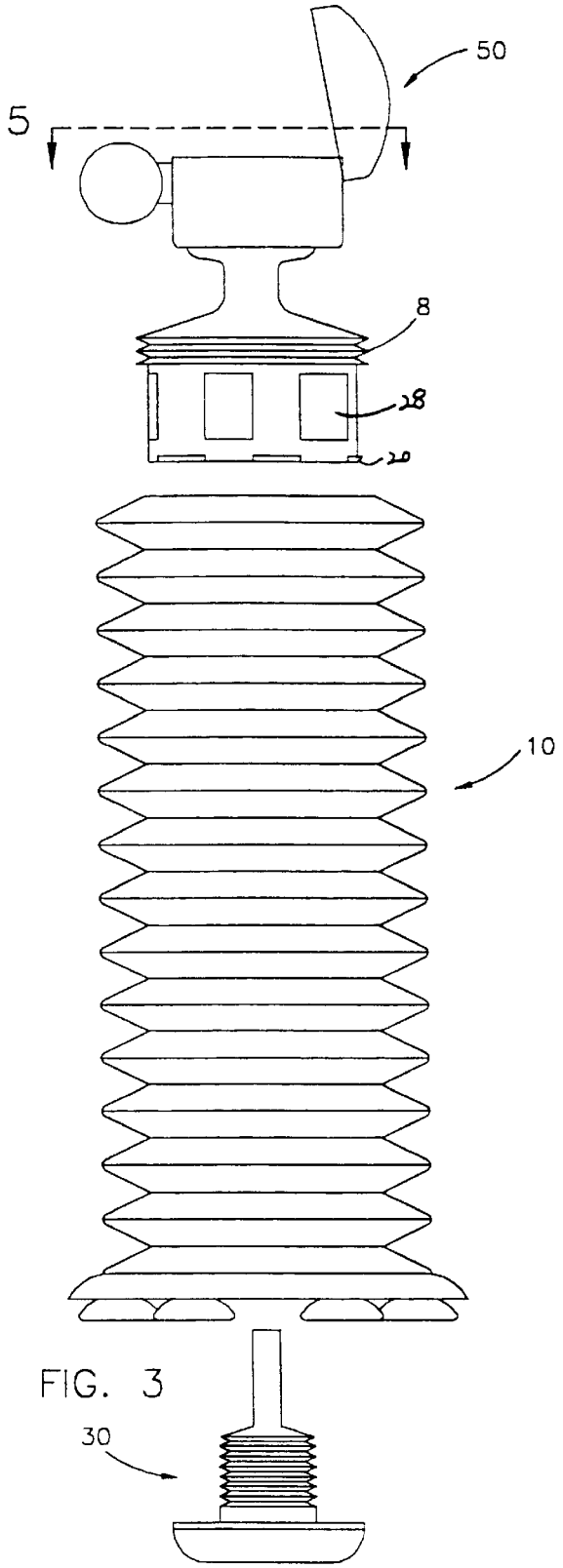
FIG. 3 is a side view similar to FIG. 2, showing separate parts of the invention arranged in relative preassembly positions.

FIG. 3 illustrates a preferred embodiment of the present invention and shows separate parts of the invention arranged in relative pre-assembled positions. FIG. 3 shows the three main parts of the invention, namely, the main storage tank 10, the top cap 50 and the bottom plug 30, separately. A spiral thread 8, formed at the top cap 50, is threaded with an internal spiral thread (not indicated) formed at the top of the main storage tank 10 to be assembled.

Figure 4:
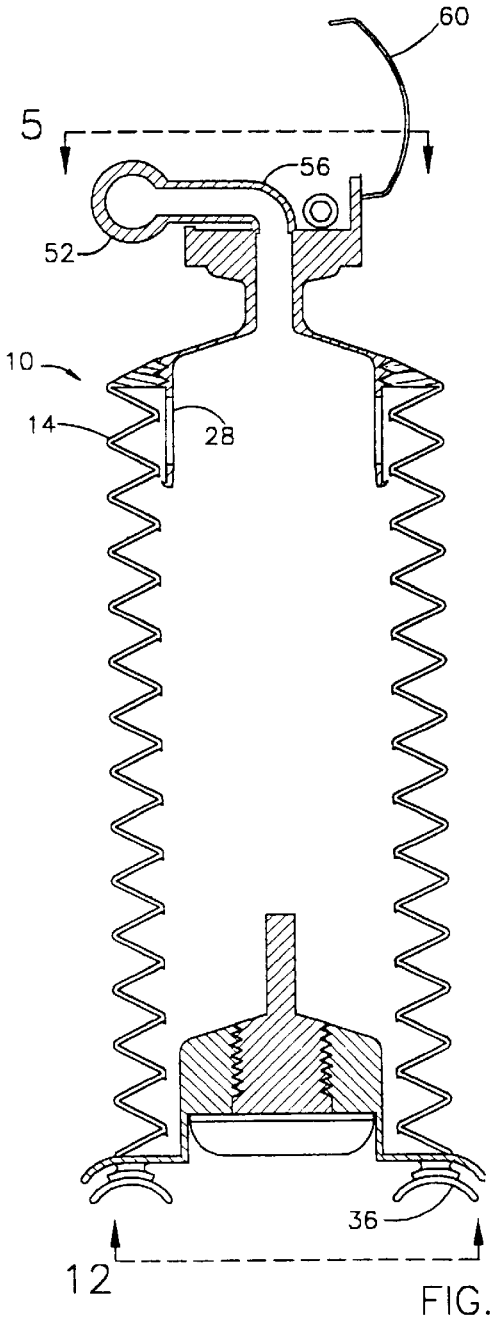
FIG. 4 is a cross sectional view of the assembled dispenser according to a preferred embodiment of the present invention.

FIG. 4 shows the interior cross section of the assembled dispenser 1 with a cap cover 60 open. The section near the top shows a tube 56 through which the contents of the storage tank 10 can be squeezed into a chamber 52 for output through the nozzle 54 (not shown in this view).

Figure 5:
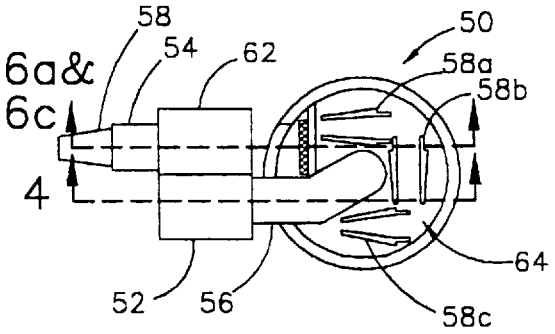
FIG. 5 is a top view of the top cap of the dispenser without a cap cover according to a preferred embodiment of the present invention.

FIG. 5 is a top view of the top cap 50 in the direction of arrow 5 in FIGS. 3 and 4. The top cap 50 has a cap compartment 64 used for storing nozzle adapters 58*a*, 58*b* and 58*c* having openings of different sizes. A nozzle adapter 58 that is installed into the nozzle 54 could be any one of the nozzle adapters, 58*a*, 58*b* or 58*c* stored in the cap compartment 64. The multiple nozzle adapters are designed for different types of storage content and/or output control. The nozzle 54 has a nozzle body 62 that is connected coaxially to the chamber 52. The nozzle 54 can be rotated to point the nozzle 54 outward for use or inward for storage.

Figure 6D:
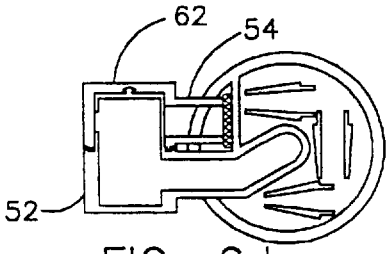
FIGS. 6*b* and 6*d* are views of the top cap of the dispenser illustrating the nozzle in an open or a closed position.
Figure 6C:
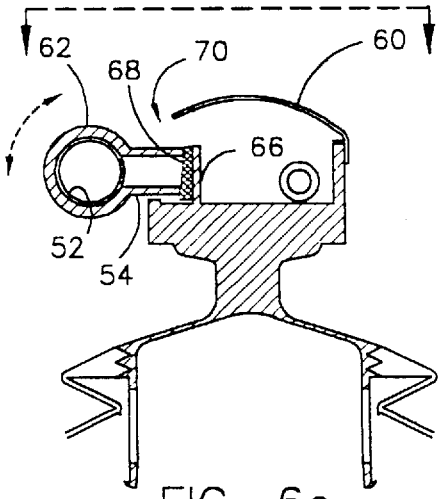
FIGS. 6*a* and 6*c* are sectional views of the top half portions of the dispenser illustrating the nozzle in open and closed positions, respectively, in the direction of arrows 6*a* and 6*c* in FIG. 5.
Figure 6E:
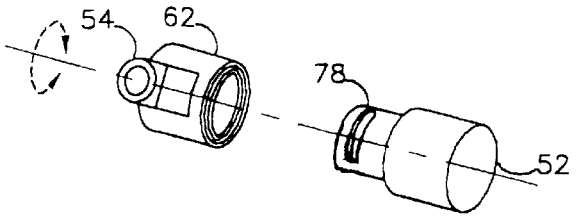
FIG. 6*e* is a perspective view of a nozzle body and a chamber according to a preferred embodiment of the present invention.
Figure 6B:
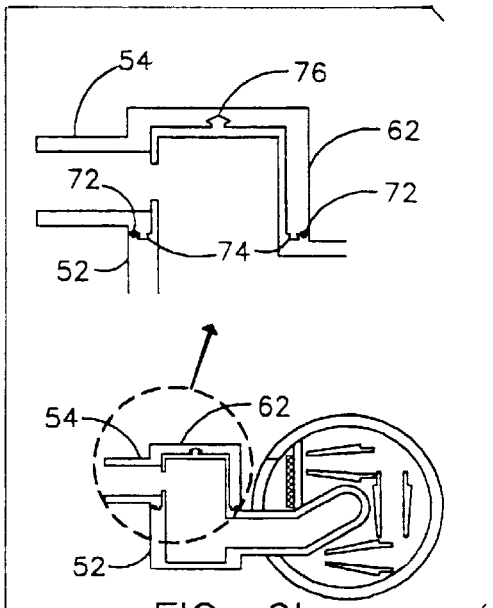
Figure 6A:
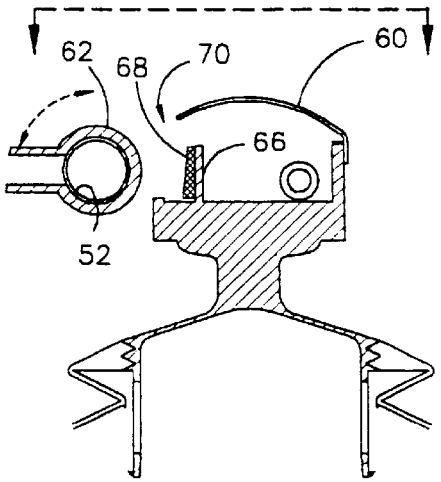

FIG. 6*a* shows the section viewed in the direction of arrow 6*a* in FIG. 5. This figure shows the condition in which the nozzle 54 is turned outwardly, without the nozzle adapter 58, so that the nozzle 54 is ready to be used to output the contents in the storage tank 10 through a tube 56.

FIG. 6*b* is a top view showing the nozzle 54 turned outward, when in use, so that the dispenser is in an open position. FIG. 6*b* further shows how the nozzle body 62 is connected, with a tight fit, to the chamber 52. An O-ring seal 72 inserted between the chamber 52 and the nozzle body 62 will ensure water tightness at the joint. Perimeter wedge locks 74 and a back center wedge lock 76 keep the nozzle body 62 secured to the walls of the chamber 52 and, at the same time, allow the nozzle body 62 to rotate.

FIG. 6*c* shows the section viewed in the direction of arrow 6*a* in FIG. 5, except the nozzle is turned inward when the dispenser 1 is not in use, with the nozzle adapter 58 removed. The mouth of the nozzle 58 is pressed tight against a cushion 68 on an upstanding wall 66, extending upwardly from the bottom wall of the cap compartment 64, for sealing to prevent the contents left in the nozzle 54 from being oxidized.

FIG. 6*d* is a top view showing the nozzle 54 turned inward, when not in use, so that the dispenser is in a closed position.

As shown in FIG. 6*e*, when turning the nozzle 54 inward for storage, the nozzle 54 passes by a slotted opening 78 in the wall of the chamber 52, and the nozzle 54 is thus closed. The nozzle 54 is further sealed against the cushion 68 for more air tightness to avoid oxidation of the material left in the chamber 52. See FIGS. 6*c* and 6*d*.

Figure 7:
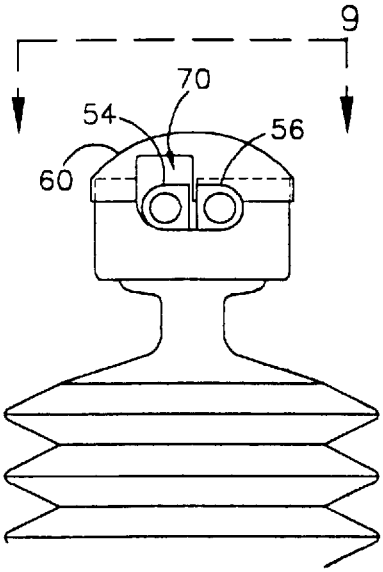
FIG. 7 is a sectional view showing the top cap in the direction of arrow 7 in FIG. 2.

FIG. 7 is a view in the direction of arrow 7 in FIG. 2. This view, with the nozzle 54 turned inward, shows that the nozzle 54 and the tube 56 each has an approximately half round shape and a round opening. An opening 70 in the top cap 50 allows the nozzle 54 to be turned inward without flip opening a cap cover 60.

Figure 8:
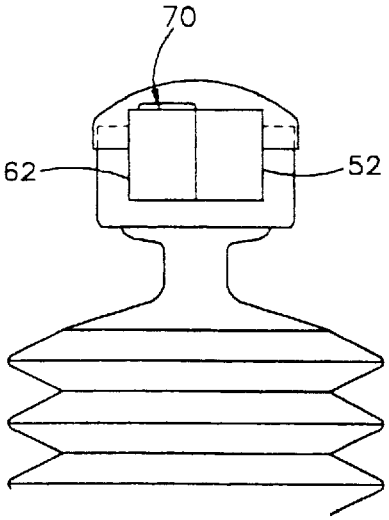
FIG. 8 is a view showing the top cap in the direction of arrow 8 in FIG. 2.

FIG. 8 is a view in the direction of arrow 8 in FIG. 2. In this exterior view, the nozzle 54 is turned inward and is not visible.

Figure 9:
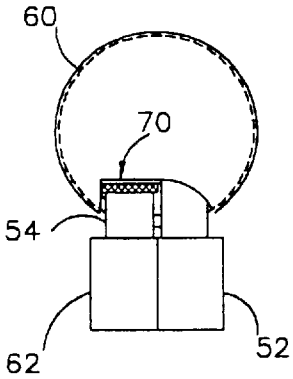
FIG. 9 is a top view of the top cap according to a preferred embodiment of the present invention.

FIG. 9 is a top view of the top cap 50. FIG. 9 illustrates a condition in which the nozzle has been turned inward when the dispenser 1 is not in use, with the nozzle adapter 58 removed, to prevent the contents left in the nozzle 54 from being oxidized. The opening 70 allows the nozzle 54, together with its body 62, to be turned inward without opening the cap cover 60.

Figure 10:
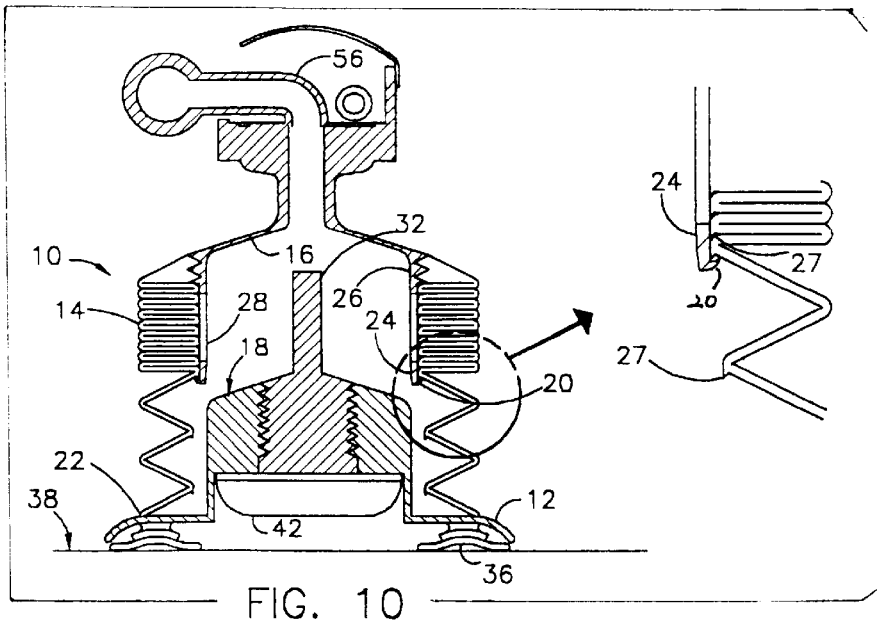
FIG. 10 is a cross sectional view showing that the collapsible side wall is folded up and a protruded lip is caught by a hook as the contents of the dispenser are gradually used-up according to a preferred embodiment of the present invention.

FIG. 10 is a cross section in a state in which the collapsible side wall 14 of the storage tank 10 is folded up when the contents of the dispenser 1 are gradually used-up. This section also shows that the suction cups 36 can be pressed flat against the flat surface 38 to provide for a semi-fixed condition to the flat surface 38. Also clear from this view is that the used-up portion of the collapsible side wall 14 is kept folded and is caught by a thickened lower edge 24 including a hook 20 formed at the lower edge of a keeper wall 26, thus reducing the height of the partially emptied tank 10. To efficiently catch the folded side wall 14 and prevent the folded side wall from sliding from the hook 20, a circumferential protruded lip 27 is formed on the inside surface of each bellows fold of the side wall 14. A series of protruded lip 27 is thus formed on the side wall. The enlarged view of the elements in the circle of FIG. 10 shows the manner in which the hook 20 and the protruded lip 27 cooperate. The keeper wall 26 has openings 28 to allow any contents left in the folded portion of the wall 14 to be squeezed into the main storage tank 10 and not be trapped behind the keeper wall 26. See FIG. 3. A bottom surface 18 of the main storage tank 10 is shaped to conform with an inside shoulder 16 of the main storage tank 10 so that the contents inside the tank 10 are efficiently used-up.

The removable bottom plug 30 has a long nose 32. When the contents of the main storage tank 10 are nearly used-up, the bottom surface 18 will be pushed up against the inside shoulder 16 of the top cap 50 and, at the same time, the nose 32 will move up and into the chamber 56. Both the surface 18 and the nose 32 will substantially empty the remaining contents in the storage tank into the chamber 56 for best usage of all the material in the main storage tank 10. A seal 22 provided by heat, adhesive or in any other way is provided between the bottom end of the collapsible side wall and the top of the tank base 12.

Figure 11:
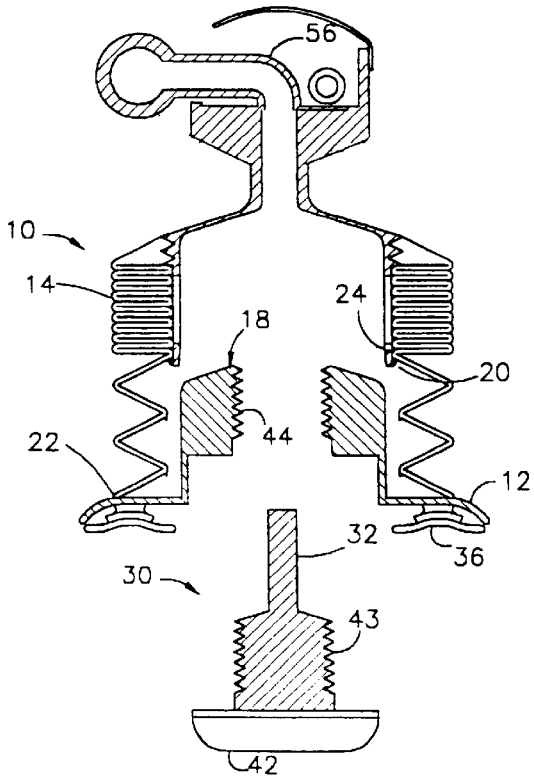
FIG. 11 is the same cross sectional view as shown in FIG. 10, except the bottom plug is removed from the main storage tank.

FIG. 11 shows the same cross section as shown in FIG. 10, except the bottom plug 30 is removed from the main storage tank 10. An internal spiral thread 44 is formed at the bottom of the main storage tank 10 and is threaded with an external spiral thread 43 formed on the outer circumferential surface of the removable bottom plug 30. By turning a handle 42 of the bottom plug 30, as better seen in FIG. 12, the bottom plug 30 can be screwed out from the main storage tank 10. Through an opening formed by removing the bottom plug 30, contents to be refilled can be refilled inside of the main storage tank 10. After refilling, the bottom plug 30 is threadedly replaced into the bottom of the main storage tank 10. The internal spiral thread 44 and the external spiral thread 43 can be made in different sizes to suit any refill container for tight connection.

Figure 12:
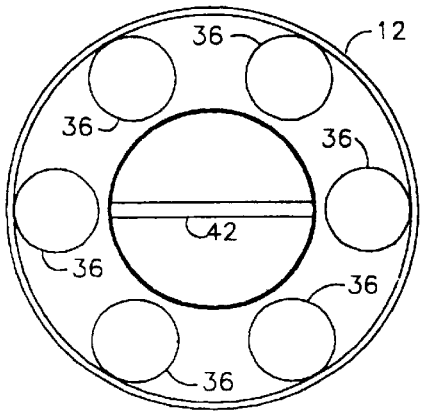
FIG. 12 is a bottom view of the dispenser in the direction of an arrow 12 in FIG. 4.

FIG. 12 is the bottom view in the direction of the arrow 12 in FIG. 4. The bottom plug 30 is threaded into the bottom of the main storage tank 10, and the base 12 is provided with the suction cups 36. By turning a handle 42 of the bottom plug 30, the bottom plug 30 can be screwed into or out from the main storage tank 10. The tank base 12 can be formed in various shapes. At the bottom of the base 12, at least three suction cups 36 are formed with or attached to the base 12. These suction cups 36 are both rigid enough to support the dispenser 1 and sufficiently flexible so that, when the dispenser 1 is pressed down on the base 12, the suction cups 36 can be flattened and adhere to a flat surface 38 as shown in FIG. 10.

To use the dispenser 1, the user simply turns the nozzle 54 to an outward direction, installs the nozzle adapter 58 if the user so desires, and inserts two fingers around a recessed space 48 provided by a narrowed neck 46 of the main storage tank 10, as shown in FIG. 2. Then, the user presses down on the top cap 50 to move the top cup and the tank base 12 towards each other. The contents in the storage tank 10 will then be outputted at a rate controlled by the user and stopped any time the pressure is released. The squeezing action provides a uniform and controllable dispensing of the contents and eliminates the usual moving parts required for a pump and an intermittent or variable output rate due to the pumping cycle. When the pressure is released, the residual contents in the nozzle 54 and chamber 52 will be sucked back into the storage tank 10 by a vacuum action.

The refill operation can be accomplished either through the top, after the top cap 50 has been removed as shown in FIG. 3, or with the threaded connection at the bottom of the storage tank 10, after the bottom plug 30 has been removed. See FIG. 11.

The entire dispenser 1 is portable and can sit on any flat surface. Alternatively, it can be adhered to a vertical or horizontal flat surface by using the suction cups 36 at the base 12 of the main storage tank 10.

It will be apparent to those skilled in the art that various modifications can be made in the collapsible dispenser without departing from the spirit or scope of the invention. Thus, it is intended that the present invention cover modifications and variations of this invention within the scope of the appended claims and their equivalents.

What I claim is:

1. A collapsible dispenser, comprising:

storage means for storing material contents including a collapsible side wall and a tank base;

a top cap attached to said storage means for outputting the material contents from said storage means;

a shoulder connecting said storage means and said top cap, said shoulder including an inside shoulder;

hook means for catching a used-up portion of the collapsible side wall to be kept folded, said hook means extended from the inside shoulder; and a bottom plug removable from the tank base of said storage means for refilling said storage means with the material contents.

2. A collapsible dispenser according to claim 1, wherein said hook means comprises a keeper wall extending from the inside shoulder, a thickened lower edge formed at a lower edge of the keeper wall, and a hook formed at the end of the lower edge.

3. A collapsible dispenser according to claim 1, wherein the collapsible side wall comprises a plurality of bellows folds and a circumferential protruded lip formed on each of said bellows folds to cooperate with said hook means to prevent sliding of a folded portion of the collapsible side wall.

4. A collapsible dispenser according to claim 2, wherein the keeper wall comprises openings for allowing residual contents left in a folded portion of the collapsible side wall to be squeezed into a volume defined by said storage means.

5. A collapsible dispenser according to claim 1, further comprising at least one suction cup attached to the tank base for supporting said dispenser and securing said dispenser to a flat surface when said dispenser is pressed down.

6. A collapsible dispenser according to claim 1, wherein said top cap further comprises:

a tube;

a nozzle for outputing material contents through said tube and having a nozzle body;

a cap compartment for storing a plurality of nozzle adapters, each of said plurality of nozzle adapters attachable to said nozzle;

a chamber connected to an end of said tube and coaxially connected to the nozzle body, said chamber having a wall including a slotted opening; and a cap cover attached to and overlying said cap compartment.

7. A collapsible dispenser according to claim 6, wherein said nozzle is rotatable between an open position present when said nozzle is rotated outward and a closed position present when said nozzle is rotated inward.

8. A collapsible dispenser according to claim 7, wherein said nozzle passes by the slotted opening in the wall of said chamber when said nozzle is rotated inward from said open position to said closed position for air tightness to avoid oxidation of the material contents left in said chamber.

9. A collapsible dispenser according to claim 6, wherein said bottom plug comprises a long nose having a shape conforming to a portion of a volume defined by said storage means.

10. A collapsible dispenser according to claim 9, wherein the long nose and a bottom surface of said storage means are pushed against the inside shoulder so as to completely discharge material contents remaining in said volume defined by said storage means into the chamber, said bottom surface having a shape conforming to the inside shoulder.

11. A collapsible dispenser according to claim 1, wherein said bottom plug comprises an external spiral thread formed on an outer circumferential surface of the bottom plug for engagement with an internal spiral thread formed at a bottom of said storage means.

12. A collapsible dispenser according to claim 11, wherein said bottom plug further comprises a handle at a bottom of said bottom plug for turning and screwing out said bottom plug from said storage means.

13. A collapsible dispenser, comprising:

a main storage tank for storing material contents including a collapsible side wall and a tank base;

a top cap attached to said storage tank for outputting the material contents from said storage tank, said top cap comprising:

a tube;

an inside shoulder;

a nozzle for outputing material contents through said tube and having a nozzle body;

a cap compartment for storing a plurality of nozzle adapters, each of said plurality of nozzle adapters attachable to said nozzle;

a chamber connected to an end of said tube and coaxially connected to the nozzle body, said chamber having a wall including a slotted opening; and a cap cover attached to said and overlying cap compartment;

hook means for catching a used-up portion of the collapsible side wall to be kept folded, said hook means extended from the inside shoulder; and a bottom plug removable from the tank base of said main storage tank for refilling said storage tank with the material contents.

14. A collapsible dispenser according to claim 13, wherein said hook means comprises a keeper wall extending from the inside shoulder, a thickened edge formed at a lower edge of the keeper wall, and a hook formed at the end of the lower edge.

15. A collapsible dispenser according to claim 14, wherein the collapsible side wall comprises a plurality of bellows folds and a circumferential protruded lip formed in each of said bellows folds to cooperate with the hook to prevent sliding of a folded portion of the collapsible side wall.

16. A collapsible dispenser according to claim 15, wherein the keeper wall comprises openings for allowing residual contents left in a folded portion of the collapsible side wall to be squeezed into a volume defined by said main storage tank.

17. A collapsible dispenser according to claim 13, further comprising at least one suction cup attached to the tank base for supporting said dispenser and securing said dispenser to a flat surface when said dispenser is pressed down.

18. A collapsible dispenser according to claim 13, wherein said nozzle is rotatable between an open position present when said nozzle is rotated outward and a closed position present when said nozzle is rotated inward.

19. A collapsible dispenser according to claim 13, wherein said bottom plug comprises a long nose having a shape conforming to a portion of a volume defined by said main storage tank.

20. A collapsible dispenser, comprising:

storage means for storing material contents including a tank base and a collapsible side wall;

a top cap attached to said storage means for outputting the material contents from said storage means, said top cap including an inside shoulder;

retaining means for retaining a used-up portion of the collapsible side wall to be kept folded, said retaining means extended from the inside shoulder, said retaining means comprising a keeper wall extended from the inside shoulder, a protruded lip formed at a lower edge of the keeper wall, and a hook formed at an end of the protruded lip;

a bottom plug removable from the tank base of said storage means for refilling said storage means with the material contents;

the collapsible side wall including a plurality of bellows folds and a circumferential protruded lip formed on each of said bellows folds to cooperate with the hook to prevent sliding of a folded portion of the collapsible side wall; and the keeper wall including openings allowing residual contents left in a folded portion of the collapsible side wall to be squeezed into a volume defined by said storage means.

21. A collapsible dispenser according to claim 20, further comprising at least one suction cup attached to the tank base for supporting said dispenser and securing said dispenser to a flat surface when said dispenser is pressed down.

22. A collapsible dispenser according to claim 20, wherein said top cap further comprises:

a tube;

a nozzle for outputing material contents through said tube and having a nozzle body;

a cap compartment for storing a plurality of nozzle adapters, each of said plurality of nozzle adapters attachable to said nozzle;

a chamber connected to an end of said tube and coaxially connected to the nozzle body, said chamber having a wall including a slotted opening; and a cap cover attached to and overlying said cap compartment.

23. A collapsible dispenser according to claim 22, wherein said nozzle is rotatable between an open position present when said nozzle is rotated outward and a closed position present when said nozzle is rotated inward.

24. A collapsible dispenser according to claim 23, wherein said nozzle passes by the slotted opening in the wall of said chamber when said nozzle is rotated inward from said open position to said closed position for air tightness to avoid oxidation of the material contents left in said chamber.

25. A collapsible dispenser according to claim 22, wherein said bottom plug comprises a long nose having a shape conforming to a portion of a volume defined by said storage means.

26. A collapsible dispenser according to claim 25, wherein the long nose and a bottom surface of said storage means are pushed against the inside shoulder so as to completely discharge material contents remaining in said volume defined by said storage means into the chamber, said bottom surface having a shape conforming to the inside shoulder.

* * * * *